US009299470B2

(12) United States Patent
Hayden et al.

(10) Patent No.: US 9,299,470 B2
(45) Date of Patent: Mar. 29, 2016

(54) ARRANGEMENT AND METHOD FOR MODIFYING THE LOCAL INTENSITY OF X-RAY RADIATION

(71) Applicants: Oliver Hayden, Herzogenaurach (DE); Lukas Richter, Erlangen (DE); Manfred Rührig, Lauf a.d. Pegnitz (DE); Oliver Schmidt, Erlangen (DE)

(72) Inventors: Oliver Hayden, Herzogenaurach (DE); Lukas Richter, Erlangen (DE); Manfred Rührig, Lauf a.d. Pegnitz (DE); Oliver Schmidt, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 80 days.

(21) Appl. No.: 14/037,954

(22) Filed: Sep. 26, 2013

(65) Prior Publication Data

US 2014/0086392 A1 Mar. 27, 2014

(30) Foreign Application Priority Data

Sep. 27, 2012 (DE) ..... 10 2012 217 616

(51) Int. Cl.
*G21K 1/10* (2006.01)
*G21K 1/04* (2006.01)
*G21K 5/04* (2006.01)

(52) U.S. Cl.
CPC .. *G21K 1/10* (2013.01); *G21K 1/04* (2013.01); *G21K 5/04* (2013.01)

(58) Field of Classification Search
CPC ..... G21K 1/10; G21K 1/04; G21K 5/04; A61N 2005/1095; G02B 26/004; G09F 9/375; A61B 6/4035; A61B 6/542
See application file for complete search history.

(56) References Cited

U.S. PATENT DOCUMENTS

| | | | | |
|---|---|---|---|---|
| 4,688,424 | A | 8/1987 | Handtmann et al. | |
| 5,559,853 | A * | 9/1996 | Linders et al. | 378/159 |
| 5,751,786 | A * | 5/1998 | Welters et al. | 378/156 |
| 5,768,340 | A * | 6/1998 | Geittner et al. | 378/159 |
| 5,881,127 | A | 3/1999 | Molloi et al. | |
| 5,966,426 | A * | 10/1999 | Marra et al. | 378/159 |
| 6,061,426 | A * | 5/2000 | Linders et al. | 378/149 |
| 6,118,855 | A * | 9/2000 | Welters et al. | 378/158 |
| 6,188,749 | B1 * | 2/2001 | Schiller et al. | 378/158 |
| 6,198,806 | B1 * | 3/2001 | Prins | 378/159 |

(Continued)

FOREIGN PATENT DOCUMENTS

| | | | |
|---|---|---|---|
| DE | 4422780 | A1 | 1/1996 |
| DE | 19543133 | A1 | 5/1997 |

(Continued)

OTHER PUBLICATIONS

German Office Action cited in German Patent Application No. 10 2012 217 616.0, dated Apr. 23, 2013, with English translation.

*Primary Examiner* — Michael Logie
(74) *Attorney, Agent, or Firm* — Lempia Summerfield Katz LLC

(57) ABSTRACT

An arrangement for modifying the local intensity of x-ray radiation includes an x-ray filter with a plurality of absorption chambers, which may be filled by a ferrofluid. The absorption chambers are stacked in the x-ray beam direction. The x-ray filter includes a plurality of storage containers in which the ferrofluid may be stored. Each of the absorption chambers is connected to a respective one of the storage containers. The absorption of the x-ray radiation is achieved as a result of individual absorption chambers being filled with the ferrofluid. By filling a different number of absorption chambers, the local intensity of the x-ray radiation may be modified easily, precisely and quickly.

19 Claims, 5 Drawing Sheets

(56) References Cited

U.S. PATENT DOCUMENTS

| | | | | |
|---|---|---|---|---|
| 6,252,939 | B1 * | 6/2001 | Young et al. | 378/156 |
| 6,269,147 | B1 * | 7/2001 | Powell | 378/158 |
| 6,275,568 | B1 * | 8/2001 | Prins et al. | 378/158 |
| 6,426,999 | B2 * | 7/2002 | Prins | 378/156 |
| 7,308,073 | B2 * | 12/2007 | Tkaczyk et al. | 378/16 |
| 8,129,701 | B2 * | 3/2012 | Al-Sadah et al. | 250/505.1 |
| 2004/0105525 | A1 * | 6/2004 | Short et al. | 378/98.8 |
| 2008/0260098 | A1 * | 10/2008 | Al-Sadah et al. | 378/65 |
| 2009/0010395 | A1 * | 1/2009 | Ein-Gal | 378/150 |
| 2011/0293069 | A1 | 12/2011 | Roberts | |
| 2013/0202092 | A1 * | 8/2013 | Haider | 378/145 |
| 2013/0343516 | A1 * | 12/2013 | Hayden et al. | 378/16 |

FOREIGN PATENT DOCUMENTS

| | | | | |
|---|---|---|---|---|
| FR | 2599886 | A1 | 12/1987 | |
| FR | 2599886 | A1 * | 12/1987 | G02B 26/02 |
| WO | 2010092516 | A1 | 8/2010 | |

* cited by examiner

ARRANGEMENT AND METHOD FOR MODIFYING THE LOCAL INTENSITY OF X-RAY RADIATION

This application claims the benefit of DE 102012217616.0, filed on Sep. 27, 2012, which is hereby incorporated by reference.

BACKGROUND

The present embodiments relate to modifying the local intensity of x-ray radiation.

In the case of examinations with the aid of x-ray beams, the organs of a patient generally have very different properties with respect to the absorption of the applied x-ray radiation in the region to be examined. Thus, for example, in the case of chest imaging, the attenuation in the region in front of the lungs is very high due to the organs arranged there, while it is very low in the lungs themselves. In order to obtain a meaningful image and to minimize patient radiation exposure, the applied radiation dose is often set depending on the region in such a way that no more x-ray radiation than necessary is supplied. A larger x-ray radiation dose may be applied in the regions with high attenuation than in regions with less attenuation. Additionally, there are applications in which only part of the region to be examined needs to be imaged with high diagnostic quality. The surrounding parts are important for orientation but not for the actual diagnosis. These surrounding regions can therefore be imaged with a lower radiation dose in order to reduce the overall applied radiation dose.

In diagnostic x-ray instruments, collimators and attenuators are positioned between the x-ray source and the patient in order to minimize the beam exposure of the patient. Often, the settings for collimators and attenuators are selected once, usually manually, by the operator of the x-ray equipment prior to x-ray imaging. The settings are often only possible in discrete steps and cannot be varied during the imaging.

The x-ray beam shape and the x-ray beam profile are typically set in three steps. The measurement beam is initially hardened during pre-filtering as a result of the soft or low-energy components of the x-ray beam being absorbed by a filter, as the low-energy components do not contribute to imaging. The thickness of the filter is often set once in discrete steps prior to the imaging via the insertion of copper disks with different thicknesses. U.S. Pat. No. 4,688,424 discloses a filter arrangement with holes. By moving the arrangement along the beam axis, the absorption of the x-ray beam is set and the intensity of the x-ray beam is varied.

If strongly absorbing tissue or materials situated near weakly absorbing tissue lie in an image field, the beam intensity within the image field is adapted by wedge-shaped filters in a second step. To this end, only a few standard geometries are available and optimum adaptation to the patient is possible to a limited extent. As an alternative, U.S. Pat. No. 5,881,127 discloses a device in which the beam profile is shaped by metallic cylinders. This device requires a multiplicity of mechanical components, making the integration of the device, for example into a C-arm, much more difficult. Moreover, it is very complicated to design the structure in such a way that the mechanical components do not leave artifacts in the space.

In a third step, a collimator restricts the image field to the region relevant for the diagnosis. The restriction is typically only possible in the form of rectangles of various sizes or other standard geometries. EP Patent No. 2395918 describes an adjustable aperture, through which the corners of a rectangle are rounded off to different extents in successive image recordings.

SUMMARY AND DESCRIPTION

The scope of the present invention is defined solely by the appended claims and is not affected to any degree by the statements within this summary.

The present embodiments may obviate one or more of the drawbacks or limitations in the related art. For example, an arrangement and an improved method are provided for modifying the local intensity of x-ray radiation.

In accordance with one aspect, an arrangement for modifying the local intensity of x-ray radiation is provided. The arrangement includes an x-ray filter with a plurality of absorption chambers that may be filled with a ferrofluid. Ferrofluids are liquids that react to magnetic fields without solidifying. The absorption chambers are arranged or stacked in the x-ray beam direction. The x-ray filter furthermore includes a plurality of storage containers in which the ferrofluid may be stored. Each absorption chamber is respectively connected to one of the storage containers. The absorption of applied x-ray radiation is achieved because individual absorption chambers are filled with the ferrofluid. The absorption of the x-ray radiation may be varied by filling a different number of absorption chambers. As more absorption chambers are filled, the absorption of the x-ray radiation increases. With thinner absorption chambers and increasing overall number of absorption chambers that may be filled by the ferrofluid, the x-ray radiation to be applied to patients may be increasingly fine-tuned by the absorption chambers. The two-dimensional homogeneity of the attenuation is provided by the defined thickness of the ferrofluid material. The local intensity of x-ray radiation may thus be modified easily, precisely and quickly.

In one embodiment, one of the absorption chambers can be respectively arranged in a plane with one of the storage containers. This arrangement may advantageously simplify the flow of the ferrofluid between the absorption chamber and the associated storage container.

In a further embodiment, the arrangement may include a pressure device that generates positive pressure or negative pressure using the ferrofluid. The flow of the ferrofluid may be controlled via the pressure device.

The pressure device may be a pressure container or a pump.

In one embodiment, a first valve may be arranged between the storage container and the pressure device to regulate the inflow and outflow of the ferrofluid between the absorption chamber and the storage container. With the aid of hydrostatic forces generated by the pressure device, the ferrofluid may be displaced from the storage container into the absorption chamber. For example, such displacement is realized by positive pressure in the pressure device when the first valve is opened. The first valve may be configured such that, when the first valve is closed, no ferrofluid flows through the first valve. The ferrofluid may be displaced back into the absorption chamber when the first valve is open with the aid of negative pressure generated by the pressure device.

The absorption chamber and the storage container may have a thickness in the x-ray beam direction of between 50 μm and 150 μm.

The stacked absorption chambers may be separated from one another by a separator layer. The separator layer may be configured such that the separator layer has very low x-ray absorption in order to minimize or reduce the loss of x-ray photons. Materials with a low atomic number and that may be formed in thin layers may be used for the separator layer.

The separator layer may include glass or polymethyl methacrylate.

In one embodiment, the absorption chamber and/or the storage container may be lined on the inside by a hydrophobic layer. Such lining reduces adhesion of the ferrofluid on the interior walls of the absorption chamber and/or of the storage container. The coating may be formed via silanization of the surface. An overview of available methods is provided in DE19543133C2.

In one embodiment, a second valve may be arranged between the absorption chamber and the storage container connected thereto. The second valve may regulate the inflow and outflow of the ferrofluid between the absorption chamber and the storage container. The second valve separates the absorption chamber from the storage container. In the event that positive pressure is generated by the pressure device, the ferrofluid from the storage container flows into the absorption chamber. The second valve renders it possible that even (e.g., equal) portions of the ferrofluid may be displaced from the storage container into the absorption chamber. Ferrofluid disposed in the absorption chamber is extracted from the absorption chamber into the storage container in the event that negative pressure is generated by the pressure device. The second valve renders it possible that even (e.g., equal) portions of the ferrofluid may be displaced from the absorption chamber into the storage container.

In one embodiment, the arrangement may include at least one electromagnet that generates a magnetic force. The electromagnet is disposed at the absorption chamber.

The local distribution of the ferrofluid in the absorption chamber may be controlled by at least one magnetic force acting on the ferrofluid. A plurality of magnets may be disposed differently at the absorption chamber to generate differently directed magnetic forces. As a result, the amount of ferrofluid disposed in the absorption chamber may be individually or distinctly established.

An aperture may be formed by the distribution of the ferrofluid.

In accordance with another aspect, a method for modifying the local intensity of x-ray radiation uses an x-ray filter. In the method, a ferrofluid is stored in a plurality of storage containers. Subsequently, a plurality of stacked absorption chambers of the x-ray filter are filled with the ferrofluid. Each of the absorption chambers is connected to a respective one of the storage containers.

The local distribution of the ferrofluid in the absorption chamber may be controlled by at least one magnetic force acting on the ferrofluid.

In one embodiment, the method may be carried out using an arrangement as described herein.

BRIEF DESCRIPTION OF THE DRAWINGS

Further details and advantages of the invention will become clear from the following description, based on schematic drawings, of several exemplary embodiments.

DETAILED DESCRIPTION

Ferrofluids may be used to generate a variable aperture. The shape of the ferrofluids is determined with the aid of magnetic fields. The homogeneity of the ferrofluid film constitutes a previously unsolved problem, e.g., when under the influence of gravity in the case of different orientations of a collimator in space, as occurs, for example, in a C-arm x-ray unit.

Figure 1:
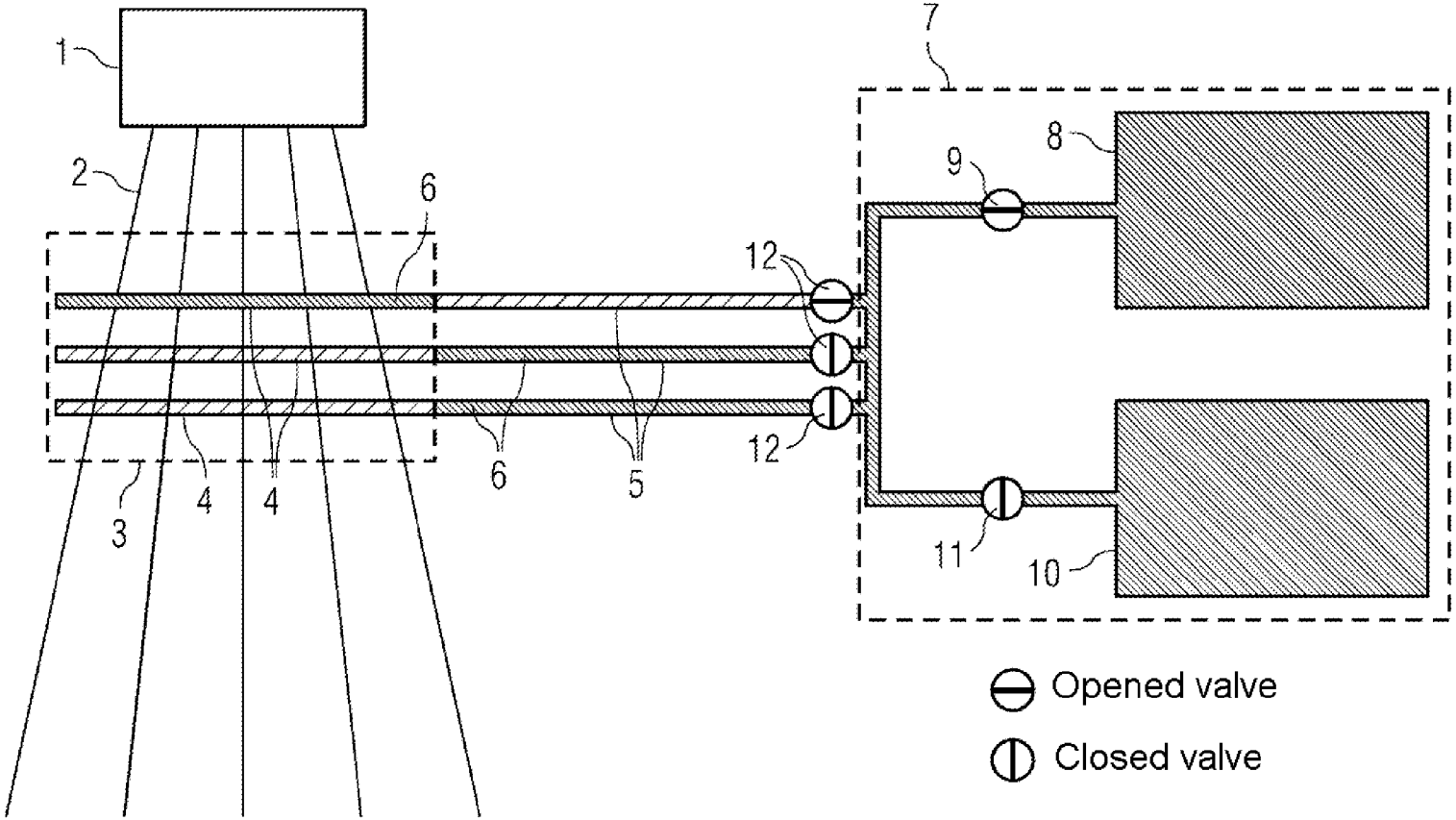
FIG. 1 shows one embodiment of an arrangement for modifying the local intensity of x-ray radiation with a first valve.

FIG. 1 shows an arrangement for modifying the local intensity of x-ray radiation with a first valve. The arrangement includes an x-ray source 1 for generating x-ray radiation 2. An x-ray filter 3 consisting of a plurality of absorption chambers 4 is disposed between the x-ray source 1 and a patient (not shown). The absorption chambers 4 may be filled with a ferrofluid 6 and are stacked in the x-ray beam direction. For example, the thickness of an absorption chamber 4 in the beam direction is 100 μm. As the thickness of each individual absorption chamber 4 decreases, the x-ray radiation 2 may be increasingly fine-tuned overall to a body region of the patient to be examined. The area of an absorption chamber 4 corresponds with the typical specifications for a collimator, e.g. $10\times10\ cm^2$. The stacked absorption chambers 4 are separated from one another by separator layers (not depicted). The spacing control between the separator layers may, for example, be established by microfluidic techniques such as SU8 or PDMS.

The arrangement further includes a plurality of storage containers 5 in which the ferrofluid 6 may be stored, i.e. retained. Each of the absorption chambers 4 is connected to a respective one of the storage containers 5 and disposed in a plane. However, in alternative embodiments, a common reservoir 5 is employed for all absorption chambers 4. A pressure device 7 includes a positive pressure reservoir 8 with a positive pressure valve 9 and a negative pressure reservoir 10 with a negative pressure valve 11. The pressure device 7 may be used to generate hydrostatic forces in the form of positive or negative pressure using the ferrofluid 6. As a result of the pressures, the absorption chambers 4 may be filled or emptied individually. First valves 12 are arranged between the storage containers 5 and the pressure device 7. With the first valves 12, the inflow and outflow of the ferrofluid 6 between an absorption chamber 4 and the storage container 5 connected thereto may be regulated. The ferrofluid 6 of a storage container 5 may be extracted from the storage container 5 and deposited into the corresponding or associated absorption chamber 4 by hydrostatic forces, which may be generated by the pressure device 7. For example, the extraction may be realized by positive pressure in the storage container 5, which is generated by opening the first valve 12 associated with the storage container 5 when positive pressure valve 9 is likewise opened and negative pressure valve 11 is closed. The ferrofluid 6 disposed in an absorption chamber 4 may be extracted from the absorption chamber 4 and deposited into the corresponding or associated storage container 5. For example, the extraction may be realized by negative pressure in the storage container 5, which is generated by opening the first valve 12 corresponding or associated with the storage container 5 when negative pressure valve 11 is likewise opened and positive pressure valve 9 is closed. FIG. 1 shows an opened positive pressure valve 9. The first valve 12 of the uppermost absorption chamber is opened. The uppermost absorption chamber 4 is filled with ferrofluid 6 from the corresponding or associated uppermost storage container 5. The two absorption chambers 4 situated therebelow are in the empty state. The corresponding storage containers 5 are depicted in the state filled with ferrofluid 6. The corresponding two first valves 12 and the negative pressure valve 11 are closed. Homogeneous attenuation of the x-ray radiation 2 may be achieved by the individual filling of the absorption chambers 4 with ferrofluid 6.

Figure 2:
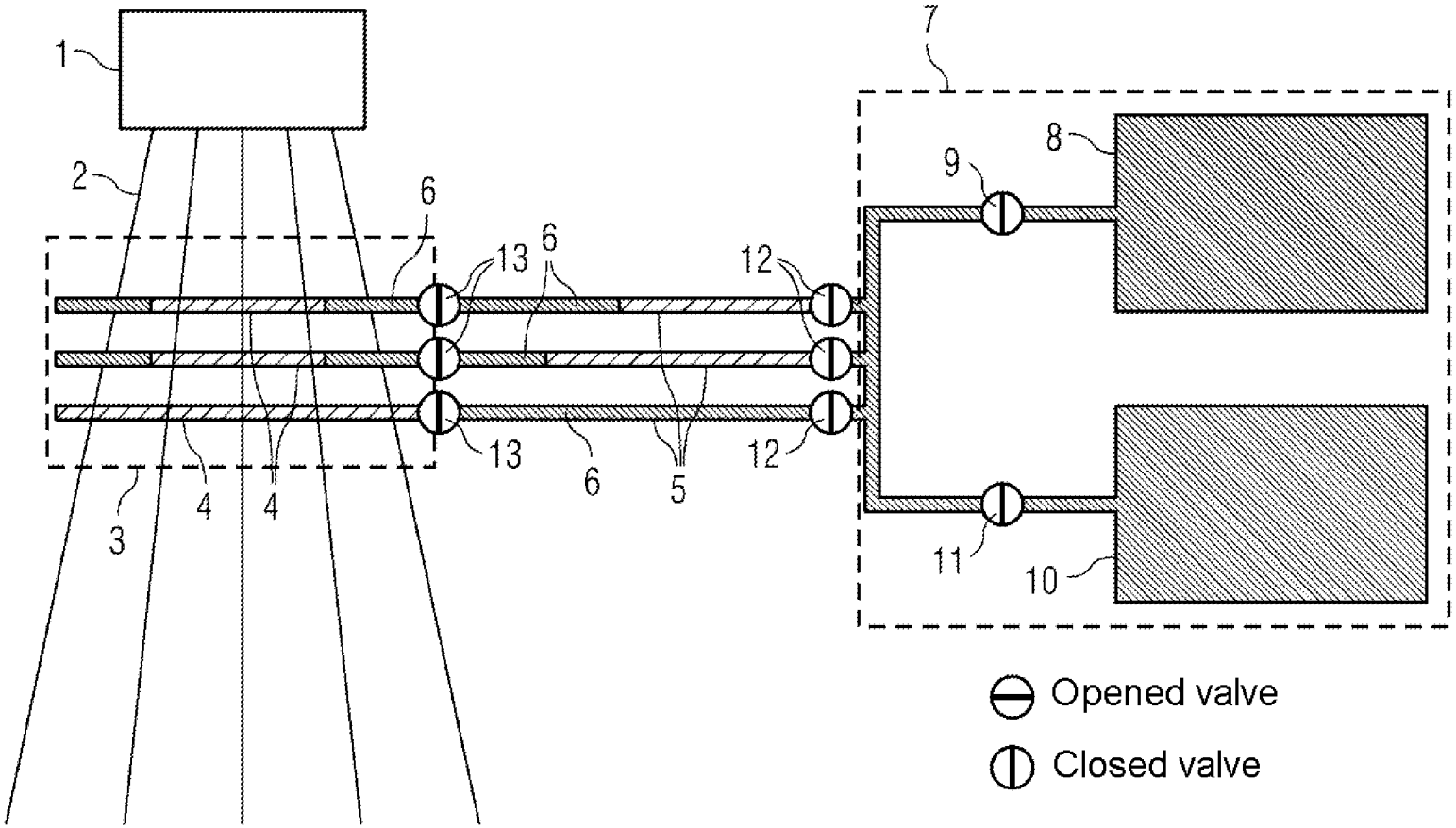
FIG. 2 shows one embodiment of an arrangement for modifying the local intensity of x-ray radiation with a first valve and a second valve.

FIG. 2 shows an arrangement for modifying the local intensity of x-ray radiation, with a first and a second valve. The components of the arrangement correspond to the components in FIG. 1. Additionally, a second valve 13 is disposed between each absorption chamber 4 and the associated storage container 5. With the second valve, the inflow and outflow of the ferrofluid 6 between the absorption chamber 4 and the storage container 5 may be regulated. The second valve separates each absorption chamber 4 from the associated storage container 5. In the event that positive pressure is generated by the pressure device 7, the ferrofluid 6 flows out of the storage container 5 into the absorption chamber 4 when first valve 12 is opened. The second valve 13 renders it possible that even (e.g., equal) portions of the ferrofluid 6 may be displaced from the storage container 5 into the absorption chamber 4. The ferrofluid 6 disposed in the absorption chamber 4 is extracted from the absorption chamber 4 and deposited into the storage container 5 in the event that negative pressure is generated by the pressure device. The second valve 13 renders it possible that even (e.g., equal) portions of the ferrofluid 6 may be displaced from the absorption chamber 4 into the storage container 5. FIG. 2 shows a partial filling of the uppermost and central absorption chambers 4 with ferrofluid 6, while the remaining amount of ferrofluid 6 is disposed in the associated storage containers 5. The lowermost absorption chamber 4 is not filled with ferrofluid 6. The entire amount of ferrofluid 6 is disposed in the corresponding or associated lowermost storage container 5. In the state shown in FIG. 2, all first valves 12, all second valves 13, the positive pressure valve 9, and the negative pressure valve 11 are closed. The amounts of ferrofluid 6 in the uppermost and central absorption chambers 4 have an aperture formed with the aid of electromagnets (not shown). A modified collimation state and local adaptation of the intensity of the x-ray radiation 2 may be achieved by the individual filling of the absorption chambers 4 with ferrofluid 6 and the subsequent forming of an aperture for the amount of ferrofluid 6 contained in the absorption chambers 4 via the electromagnets. As an alternative to employing a plurality of electromagnets for forming individual apertures, only one electromagnet may be employed, the electromagnetic field of which acts equally on all absorption chambers 4.

Figure 3:
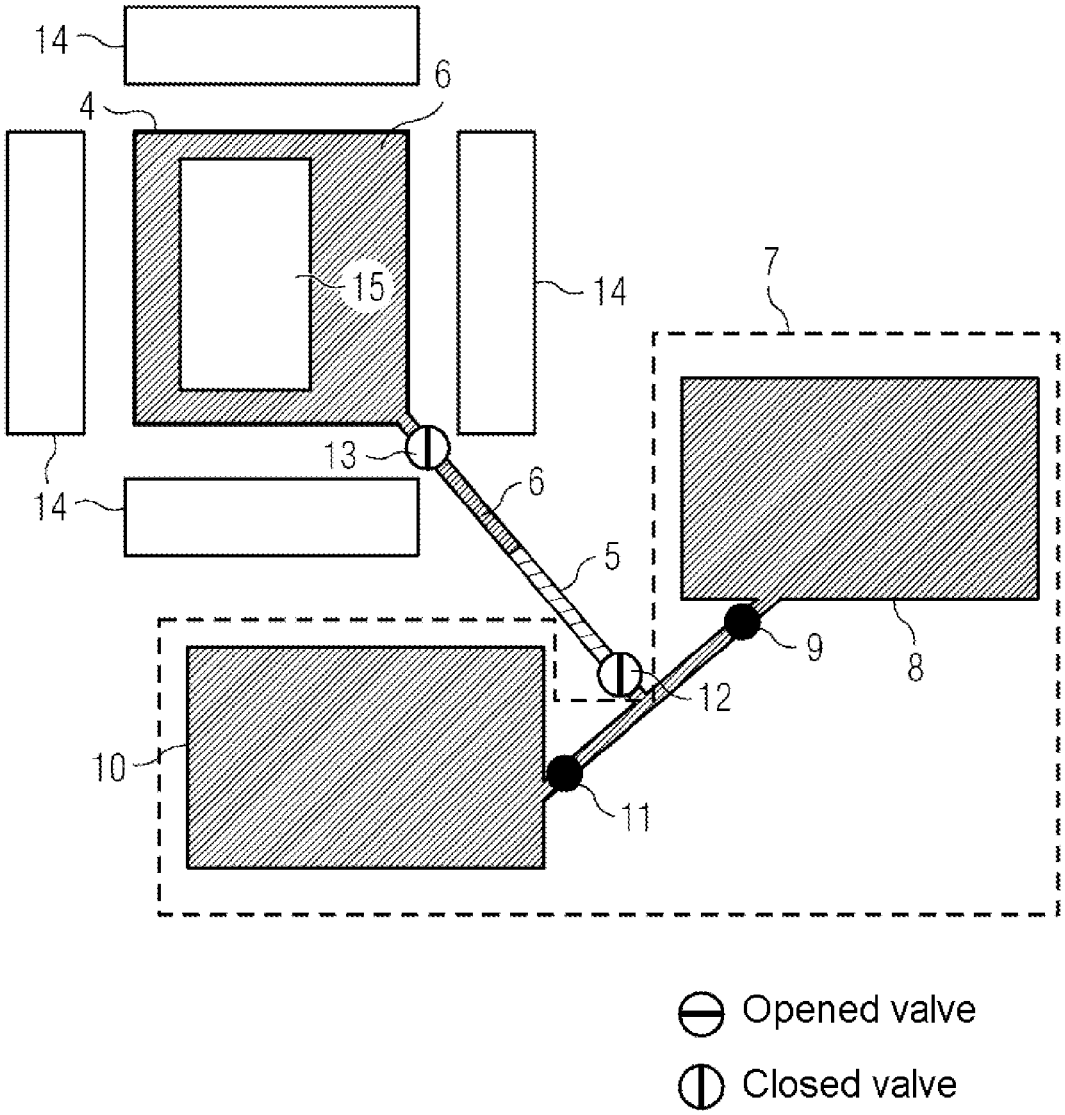
FIG. 3 shows one embodiment of an arrangement for modifying the local intensity of x-ray radiation with an absorption chamber surrounded by electromagnets.

FIG. 3 depicts an arrangement for modifying the local intensity of x-ray radiation with an absorption chamber surrounded by electromagnets. An absorption chamber 4 is surrounded by electromagnets 14. The absorption chamber 4 is separated from a storage container 5, in which a ferrofluid 6 may be stored, by a second valve 13. Via a first valve 12, the storage container 5 is connected to a pressure device 7 including a positive pressure reservoir 8, a positive pressure valve 9, a negative pressure reservoir 10 and a negative pressure valve 11. The inflow and outflow of the ferrofluid 6 between the storage container 5 and the absorption chamber 4 may be regulated by the first valve 12 and the second valve 13. For example, tubes at a corner of the absorption chamber 4 deposit the ferrofluid 6 into the absorption chamber 4. As an alternative to the depicted cubic form of the absorption chamber 4, other embodiments of the absorption chamber 4 may be round or oval. Fewer remains of ferrofluid 6 are to be expected when emptying the absorption chamber 4. The electromagnets 14 may be used to form an aperture 15 for the amount of ferrofluid 6 disposed in the absorption chamber 4. A local adaptation of the intensity of x-ray radiation directed perpendicularly to the absorption chamber 4 may thus be achieved.

Figure 4:
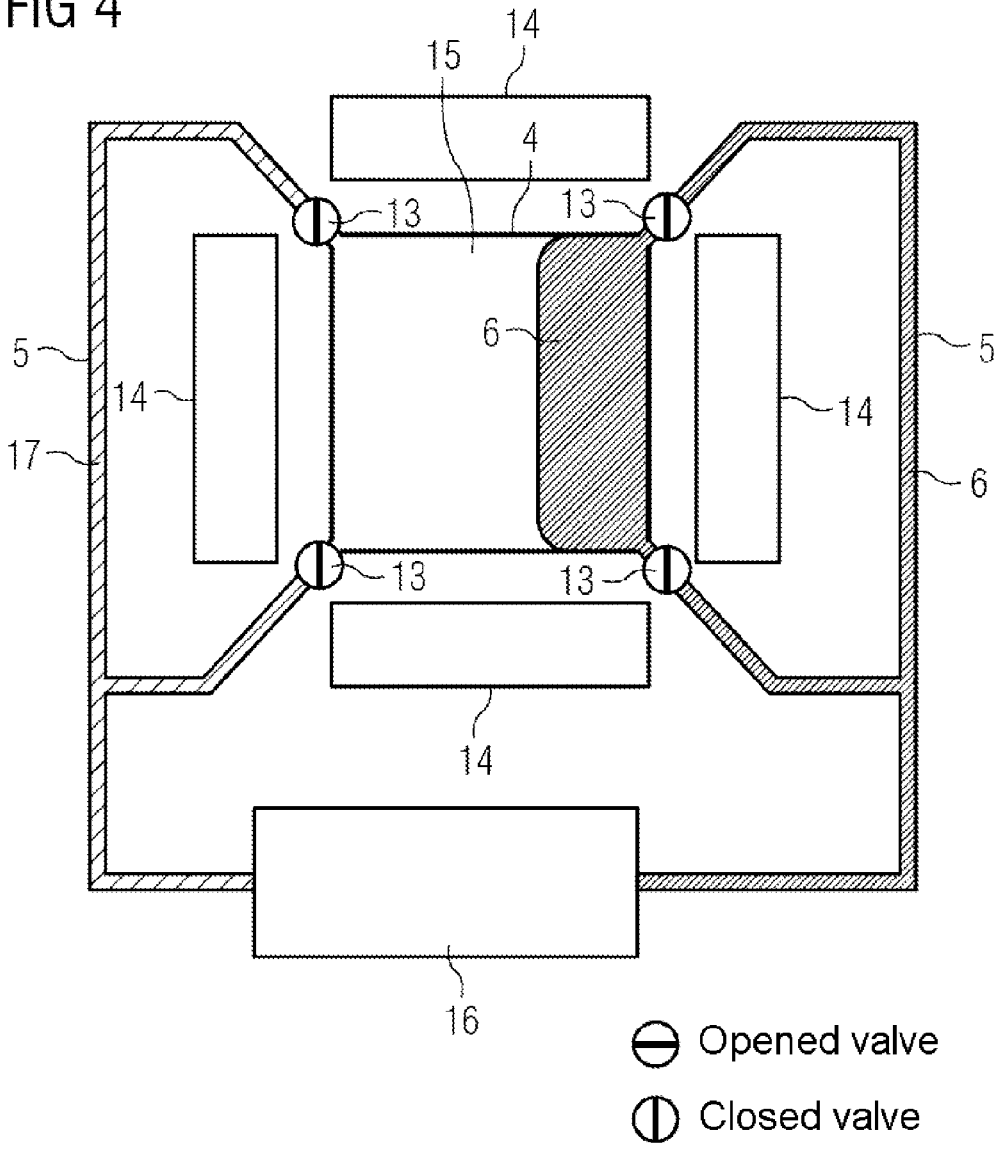
FIG. 4 shows one embodiment of an arrangement for modifying the local intensity of x-ray radiation with an absorption chamber surrounded by electromagnets and a peristaltic pump.

FIG. 4 shows an arrangement for modifying the local intensity of x-ray radiation with an absorption chamber surrounded by electromagnets and a peristaltic pump. There is respectively half ferrofluid 6 and half carrier oil 17 in a closed loop in a storage container 5. A peristaltic pump 16 may be used to pump the ferrofluid 6 into an absorption chamber 4, which is separated from the storage container 5 by second valves 13, and remove the ferrofluid 6 therefrom again as well. In the initial state, the absorption chamber 4 is likewise filled with the carrier oil 17. The absorption chamber 4 is also surrounded by electromagnets 14. An aperture 15 may be formed for the amount of ferrofluid 6 disposed in the absorption chamber 4 via the electromagnets 14. As a result of this arrangement, the microfluidic system is free from air. When pumping the ferrofluid 6 away from the absorption chamber 4, the ferrofluid 6 may be rinsed into a corner of the absorption chamber 4 provided with an outlet with the aid of the electromagnets 14.

Figure 5:
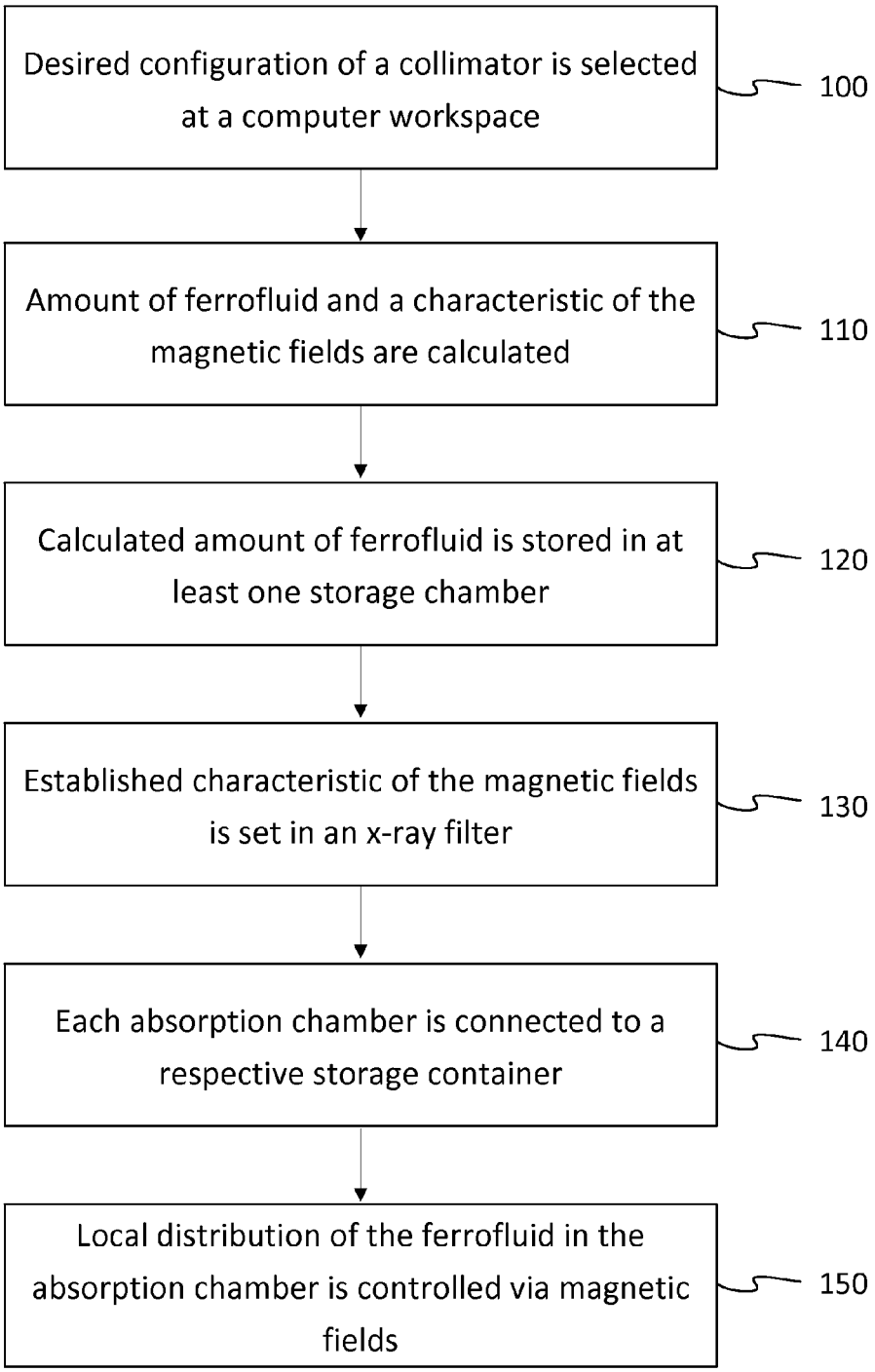
FIG. 5 shows a flowchart of one embodiment of a method for modifying the local intensity of x-ray radiation with a first valve and a second valve.

FIG. 5 describes a flowchart of a method for modifying the local intensity of x-ray radiation with a first valve and a second valve. In an act 100, a desired configuration (e.g., form) of a collimator is selected at a computer workspace. Subsequently, an appropriate amount of ferrofluid 6 and a characteristic of the magnetic fields used for realizing the desired collimator form are calculated in the act 110. In the act 120, the calculated amount of the ferrofluid is stored in at least one storage chamber. In the act 130, the established characteristic of the magnetic fields is set in an x-ray filter. In the act 140, a plurality of absorption chambers of the x-ray filter are filled with the ferrofluid. Each of the absorption chambers is connected to a respective one of the storage containers. In the act 150, the local distribution of the ferrofluid in the absorption chamber is controlled via magnetic fields being generated in accordance with the established characteristic.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. An arrangement for modifying local intensity of x-ray radiation, the arrangement comprising:

an x-ray filter comprising a plurality of absorption chambers, each absorption chamber being configured to be filled by a ferrofluid and stacked in a direction of the x-ray radiation;

a plurality of storage containers configured for storage of the ferrofluid, wherein each absorption chamber is respectively connected to one of the storage containers;

a pressure device connected to the plurality of storage containers and configured to generate positive pressure or negative pressure using the ferrofluid, the pressure device comprising a positive pressure reservoir having a positive pressure valve and a negative pressure reservoir having a negative pressure valve; and separator layers that separate the stacked absorption chambers from one another, wherein each separator layer is positioned between, adjacent to, and parallel with a wall of one absorption chamber and a separate wall of an additional absorption chamber, each separator layer having an x-ray absorption configured to minimize or reduce a loss of x-ray photons.

2. The arrangement as claimed in claim 1, wherein a respective one of the absorption chambers is respectively arranged in a plane with one of the storage containers.

3. The arrangement as claimed in claim 1, further comprising a first valve disposed between a storage container of the plurality of storage containers and the pressure device, wherein inflow and outflow of the ferrofluid between an absorption chamber of the plurality of absorption chambers and the storage container is regulated by the first valve.

4. The arrangement as claimed in claim 1, wherein each absorption chamber of the plurality of absorption chambers and each storage container of the plurality of storage containers has a thickness in the x-ray beam direction of between 50 μm and 150 μm.

5. The arrangement as claimed in claim 1, wherein each separator layer comprises glass or polymethyl methacrylate.

6. The arrangement as claimed in claim 1, wherein each absorption chamber of the plurality of absorption chambers, each storage container of the plurality of storage containers, or each absorption chamber and each storage container is lined on the inside by a hydrophobic layer.

7. The arrangement as claimed in claim 1, further comprising at least one electromagnet that generates a magnetic force.

8. The arrangement as claimed in claim 7, wherein the at least one electromagnet is disposed at one or more absorption chambers of the plurality of absorption chambers.

9. The arrangement as claimed in claim 1, wherein a local distribution of the ferrofluid in an absorption chamber of the plurality of absorption chambers is controlled by at least one magnetic force acting on the ferrofluid.

10. The arrangement as claimed in claim 9, wherein an aperture is established by the local distribution of the ferrofluid.

11. The arrangement as claimed in claim 1, wherein the pressure device is configured to generate hydrostatic forces in form of the positive pressure or the negative pressure.

12. An arrangement for modifying local intensity of x-ray radiation, the arrangement comprising:

an x-ray filter comprising a plurality of absorption chambers, each absorption chamber being configured to be filled by a ferrofluid and stacked in a direction of the x-ray radiation;

a plurality of storage containers configured for storage of the ferrofluid, wherein each absorption chamber is respectively connected to one of the storage containers;

a pressure device connected to the plurality of storage containers and configured to generate positive pressure or negative pressure using the ferrofluid, the pressure device comprising a positive pressure reservoir having a positive pressure valve and a negative pressure reservoir having a negative pressure valve; and a pair of valves positioned in series between the pressure device and each absorption chamber, wherein a first valve of the pair of valves is disposed between a respective storage container of the plurality of storage containers and the pressure device, and wherein a second valve of the pair of valves is disposed between a respective absorption chamber of the plurality of absorption chambers and an associated storage container of the plurality of storage containers connected in series thereto, wherein the inflow and outflow of the ferrofluid between each absorption chamber and associated storage container is further regulated by the second valve respective pair of valves.

13. A method for modifying local intensity of x-ray radiation using an x-ray filter, the method comprising:

storing a ferrofluid in a plurality of storage containers;

filling a plurality of stacked absorption chambers of the x-ray filter with the ferrofluid, wherein each absorption chamber is connected to a respective one of the storage containers, and wherein separator layers separate the plurality of stacked absorption chambers from one another, wherein each separator layer is positioned between, adjacent to, and parallel with a wall of one absorption chamber and a separate wall of an additional absorption chamber, each separator layer having an x-ray absorption configured to minimize or reduce a loss of x-ray photons; and generating positive pressure or negative pressure using the ferrofluid with a pressure device comprising a positive pressure reservoir having a positive pressure valve and a negative pressure reservoir having a negative pressure valve, wherein the pressure device is connected to the plurality of storage containers.

14. The method as claimed in claim 13, further comprising arranging a respective one of the absorption chambers in a plane with one of the storage containers.

15. The method as claimed in claim 13, further comprising controlling a local distribution of the ferrofluid in an absorption chamber of the plurality of absorption chambers by at least one magnetic force acting on the ferrofluid.

16. The method as claimed in claim 15, wherein controlling comprises generating the at least one magnetic force by at least one electromagnet.

17. The method as claimed in claim 16, wherein the at least one electromagnet is disposed at one or more absorption chambers of the plurality of absorption chambers.

18. The method as claimed in claim 13, wherein each absorption chamber of the plurality of absorption chambers and each storage container of the plurality of storage containers has a thickness in the x-ray beam direction of between 50 μm and 150 μm.

19. The method as claimed in claim 13, wherein the generating comprises generation of hydrostatic forces in the form of the positive pressure or the negative pressure.

* * * * *